United States Patent [19]

Spöler et al.

[11] 4,098,036

[45] Jul. 4, 1978

[54] ELEVATED TRAIN STATION

[75] Inventors: Johannes-Gerhard Spöler, Ennepetal-Voerde; Uwe Lichtenvort, Essen, both of Germany

[73] Assignee: Demag A.G., Duisburg, Germany

[21] Appl. No.: 732,303

[22] Filed: Oct. 14, 1976

[30] Foreign Application Priority Data

Oct. 30, 1975 [DE] Fed. Rep. of Germany ..... 2548555

[51] Int. Cl.[2] ..... E04D 13/08; E04B 1/346

[52] U.S. Cl. ..... 52/16; 52/64; 52/73; 52/184; 52/236.3; 52/30; 104/28

[58] Field of Search ..... 52/236.3, 73, 79, 648, 52/690, 236.4, 184, 236.3, 27, 30, 16; 14/14; 212/144, 145; 46/39, 40, 231; 160/1, 9, 201; 242/158 B; 104/27, 28, 30

[56] References Cited

U.S. PATENT DOCUMENTS

| | | | |
|---|---|---|---|
| 1,462,868 | 7/1923 | Newman | 104/30 |
| 1,820,034 | 8/1931 | Schuberth | 104/27 |
| 2,128,539 | 8/1938 | Roach | 52/73 |
| 3,192,633 | 7/1965 | Pratt | 52/236.3 X |
| 3,659,387 | 5/1972 | Pearson, Jr. | 52/236.3 X |
| 3,675,584 | 7/1972 | Hall | 104/28 |
| 3,712,008 | 1/1973 | Georgiev et al. | 52/236.3 X |
| 3,818,654 | 6/1974 | Schramm | 52/236.3 X |

*Primary Examiner*—Alfred C. Perham
*Assistant Examiner*—Robert C. Farber
*Attorney, Agent, or Firm*—Mandeville and Schweitzer

[57] ABSTRACT

The station, including access stairs and elevator systems are supported by a single vertical girder to reduce the space requirement for the station in a crowded inner city. Various components of the station may be prefabricated and then joined together at the site to standardize and reduce construction costs, and to reduce construction interference at the station site.

25 Claims, 11 Drawing Figures

ELEVATED TRAIN STATION

BACKGROUND AND STATEMENT OF THE INVENTION

The disclosure covers and elevated train station with platform, particularly for an inner city transit system.

Such an elevated train station has been disclosed in the study made by DEMAG and Messerschmitt-Boelkow-Blohm dated 1972. The platforms of this station are supported at each end by girders, as is usual for pedestrian bridges or similar structures. In densely populated inner cities, however, it is not always possible to find sufficient space for the girders of elevated train stations due to the arrangement of streets and sidewalks.

It is the object of the present invention to design an elevated train station in such a fashion that it may be erected in all locations of a transit system where stations are in order without interference and/or major changes in streets and sidewalks. This is solved by supporting the platform of the elevated train station with one girder only. A platform for short distance transit systems being approximately 10 to 12 meters in length, the arrangement stays within a range permitting the use of only one girder to transmit load and possible pitching moments and wind pressures onto the foundation. Such a single girder may thus be erected on a traffic island, a sidewalk or sidewalk corner without affecting pedestrian and automobile traffic any more than absolutely necessary. Further space required for any additional girders might be located in the middle of traffic lanes. When erecting a single girder elevated train station on a traffic island, the station is, in most cases, far enough removed from the nearest buildings, as not to infringe upon the rights of their inhabitants and/or owners. The ends of the elevated train station are located above the streets. Depending upon the course of the rail, the platform may be attached to the rail girder with additions as required.

A staircase leading to the platform may be attached to the girder. The girder itself may be designed as an elevator shaft. The elevator may be installed later on if it proves to be necessary only during the course of operation. A cantilever beam may be attached on the girder under which to arrange the platform with its roof. The platform is attached to the roof at its ends via end walls, and at the back by means of suspension bars.

One advantage of this type of elevated train station is that the structural groups manufactured in light-weight construction can be delivered to the construction site as prefabricated parts for quick assembly there. No time-consuming erection of construction fence and auxiliary stairs is needed. Traffic is only affected for a very short period of time, sometimes only for the duration of a night when traffic is slow.

If local conditions permit, the staircase is attached to the girder on the side opposite the platform thus becoming a countermoment to take some of the load off the girder and the foundation. The girder, staircase and cantilever beam have small dimensions and may be transported on a normal truck. Only the platform complete with roof requires a special truck of the relatively small service load of 10 tons approximately on account of its dimensions. One of the smaller mobile cranes will suffice for assembly of the elevated train station. If an elevated train station with superimposed stations is involved, the girder of the upper platform is preferably attached to the cantilever beam of the lower platform.

Thus the platforms are uniformly designed; it is only necessary to reinforce the lower cantilever beam to receive the load of the upper platform. To decrease the pitching moment, the platforms may project into opposite directions from the girder. The upper part of the girder is then fitted with another staircase.

In further development of the invention, the roof of the platform is designed as a wing or suspension assembly and attached under the cantilever beam. The roof consists of an upper plate whose longitudinal sides are shaped as an inverted U just above head height. Below the plate U-shaped cut-out cross stays extending to the ends of the inverted U are provided, the lower edges of such cross stays being interconnected via a flat longitudinal profile or plate and with the longitudinal sides of the roof plate. Thus, the roof forms a stable support. This shape not only results in a statically favorable support element, but functionally it has the advantage that the space above the platform is of sufficient height to permit the handling of long pieces, e.g. skis. This inverted U-shaped roof reduces the open portion of the platform to head level so that there is enough protection against snow and rain in the rear part or open side of the roof-covered platform. Furthermore, the overhanging roof edge near the platform serves as a warning when handling long objects while entering the vehicles.

To reinforce the roof, the area of the cantilever beam is, on the inside next to the bent-down front and rear longitudinal sides of the roof plate, fitted with one reinforcement stay each penetrating the roof plate on top and provided with one screw-on flange each for the cantilever beam. The ends of the reinforcement stays may be bevelled and, starting from the cantilever beam, extends to one or two cross stays. The reinforcement stays are welded with the longitudinal profiles or plates and form a stable box profile together with the roof plate and its bent-down longitudinal edges.

The end walls mentioned previously are interconnected at the platform side below the floor of the platform by means of a floor longitudinal beam. The end walls are so stable that they prevent lateral displacement of the floor vs. the roof. The rear of the roof-covered platform, at the bent-down or overhanging edge of the roof, is fitted with suspended bars for the rear ends of floor cross beams, their front ends being attached to the floor longitudinal beam. The suspended bars are equipped with contact surfaces or frames to attach glass panes and represent, furthermore, the simplest and easiest structural means of supporting the floor cross beams in the rear wall area. To prevent longitudinal displacement of the floor vs. the roof a portion of the rear side wall and a front wall area of the roof-covered platform may be equipped with stays. The space between the walls equipped with stays, particularly the end wall, is suitable as a maintenance and/or machine room, which should be present at any elevated train station. This room is preferably located at that side of the roof-covered platform which projects the least past the girder, thus forming a countermoment for the longer portion of the platform.

In further development of the invention, the roof described above is provided with a raised circumferential edge or rim protruding past the roof plate. Within the space surrounded by the raised edge, the roof is provided with a water retention area connected to a gutter pipe in water-tight connection, such pipe going through the maintenance and machine room towards the girder, thus not taking away from the appearance of the elevated train station. The raised edge consists of a rim directed upward from the roof plate whose edge, as mentioned before, overhangs. The roof plate may be fitted at the interior of the rim with suspension eyelets which facilitate suspension from the crane during assembly. The suspension eyelets are attached near the four corners of the roof, therefore in an especially stable area, so that no reinforcement of the roof is required for the suspension eyelets. Furthermore, being arranged at the interior of the rim they do not interfere with the optical picture and do not have to be removed after assembly.

The floor of the roof-covered platform is preferably made of sound deadening light concrete, e.g. prefabricated elements which are placed on the edge of the floor longitudinal beams and cross beams.

In stations for suspended vehicles the invention provides the edge of the floor longitudinal beam with a device serving as protection against falling, such protective device being essentially horizontal and protruding beyond the platform edge; it consists preferably of a thin steel mesh attached to a frame. The thin steel mesh, giving the appearance of being too weak to stand on, has the advantage of not being stepped on intentionally. A seemingly strong protective device would seem like an invitation to willful persons to step on so that an additional protection would have to be present.

The staircase preferably consists of two stair wells or flights, their sections being connected in the area of an intermediate landing, and upper and lower ends being attached to the girder. The staircase sections together with the girder form a triangle stable in itself, only tensile and compressive forces occurring in its parts in the manner of a lattice. The cross sections of the staircase each form a supporting profile spanning the stairs and well, the side walls of such supporting profile being provided with an opening at the height of the intermediate landing of one flight for admission to the intermediate landing of the other flight. The supporting profile of each staircase section consists of a U-shaped upper belt or frame and a U-shaped lower belt or frame, their edges directed towards each other and connected to each other. As no great forces occur, the belts alone are strong enough to receive the tensile and compressive forces of the lattice, and due to their connection with each other they are capable of receiving the load of the staircase. The upper and lower belts or frame are connected with each other via vertical rods which are designed as attachment moldings or frames for glass panes. The sections of the staircase, after being screwed in place at the level of the intermediate landing and after being screwed to the girder, form a very solid structural unit with little empty weight, which can be used right after the start of the assembly. To make assembly easier, the upper belt is provided with suspension eyelets, the same as the roof plate of the platform.

The girder consists of four corner columns with strutting or cross-bracing which may be covered. The struts prevent outward bending of the girder corner columns which are subject to eccentric load, and which accommodate the elevator shaft. The strutting results in a bracing of the girder which roughly corresponds to that of a closed box profile. Thus sufficient stability is guaranteed even if the platform projects very far. The girder is covered to protect it from atmospheric conditions. The covered or lining consists partially, e.g. on one side, of transparent material, so that people in the elevator retain eye contact with their surroundings. The rain gutter mentioned previously leads from the roof-covered platform through the girder and may end in the sewer system or may emerge from the girder above ground, depending upon circumstances. The girder contains all supply lines leading from the foundation to the platform.

Preferably, the elevator shaft goes so far below the ground, that a space is left below the elevator to accommodate an elevator hoisting mechanism, for a hydraulic installation with telescope cylinders. Such installation needs little maintenance and is of low structural height. The space for the elevator hoisting mechanism may be entered even while the elevator is lowered, from an inspection shaft located beneath the landing in front of the first stair.

The girder must be anchored on a tilt-resistant foundation, preferably a drill pole foundation. This foundation structure offers room between the individual poles for an easily accessible location of sewage connections and the elevator hoisting mechanism. The cantilever beam is made of a stable box profile provided with cross stays to transmit bending and torsional stress. It may be so long that there is a space left between girder and platform. This may be necessary if due to local conditions the girder cannot stand directly to the platform and the course of the elevated rail does not permit moving the platform.

During assembly, the cantilever beam may first be attached to the roof-covered platform and together with the latter attached to the girder within a very short period of time. The roof-covered platform is connected to the cantilever beam by means of screws via its screw flanges. By means of additional screws, the cantilever beam is attached to a cover plate of the girder. The sequence of assembly may vary. It is advisable to finish first the less accessible screw connections between cantilever beam and roof of the platform or cantilever beam and girder, so that the use of a crane during the final steps of assembly is kept to a minimum. In the type of construction chosen it is recommended to provide surface protection for all parts of the elevated train station while still in the shop. Damage to the surface protection during transport and assembly is not to be expected; should some damage occur nevertheless, it may be removed easily and quickly.

For a further understanding of the invention, reference is made to the drawings, showing illustrative examples of the elevated railway platforms of the invention.

DETAILED DESCRIPTION OF THE INVENTION

Figure 1:
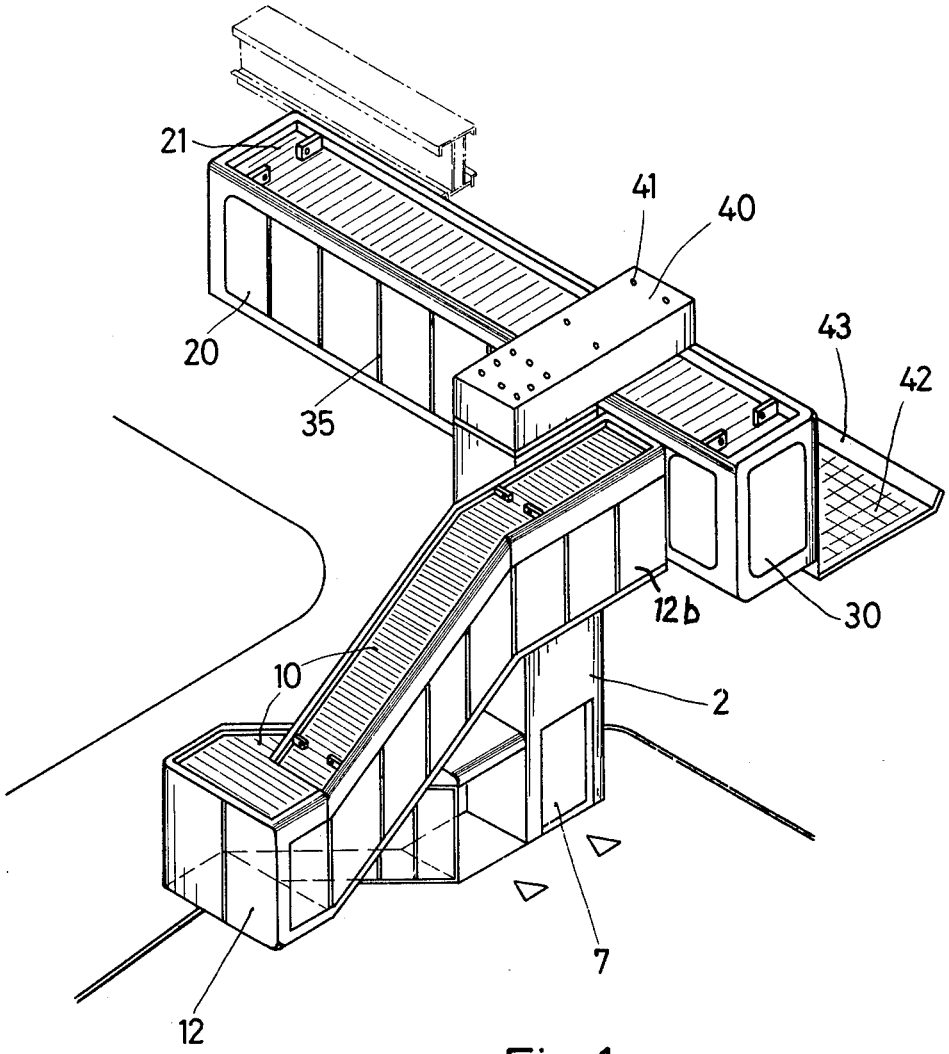
FIG. 1 is a view in perspective of an elevated railway station illustrating the invention.

FIG. 1 shows a simple elevated train station for rail vehicles not shown which run along a girder indicated in dot-dash line. Small cabins for few passengers are involved. Platform 20 provided with roof 21 therefore only requires a relatively short length of approximately 12 meters. The platform 20 is supported at its roof via cantilever beam 40 by girder 2 which rests on a sidewalk. Highly resistant screws 41 serve to attach cantilever beam 40 to girder 2 as well as roof 21 below cantilever beam 40. At the top and bottom of girder 2 a two-well or flight staircase 10 is attached whose individual flights are screwed together at the level of intermediate landing 12. The inside of girder 2 houses an elevator shaft 7 which is provided, on top, with an opening leading to the upper landing 12*b*. Below the floor of platform 20 a protection against falling from the platform is provided at the open side in the form of a thin steel mesh 42 supported by frame 43. End walls 30 consist of stable plates equipped with reinforced edges, while the rear side wall is provided with glass panes between suspended bars 35.

Figure 2:
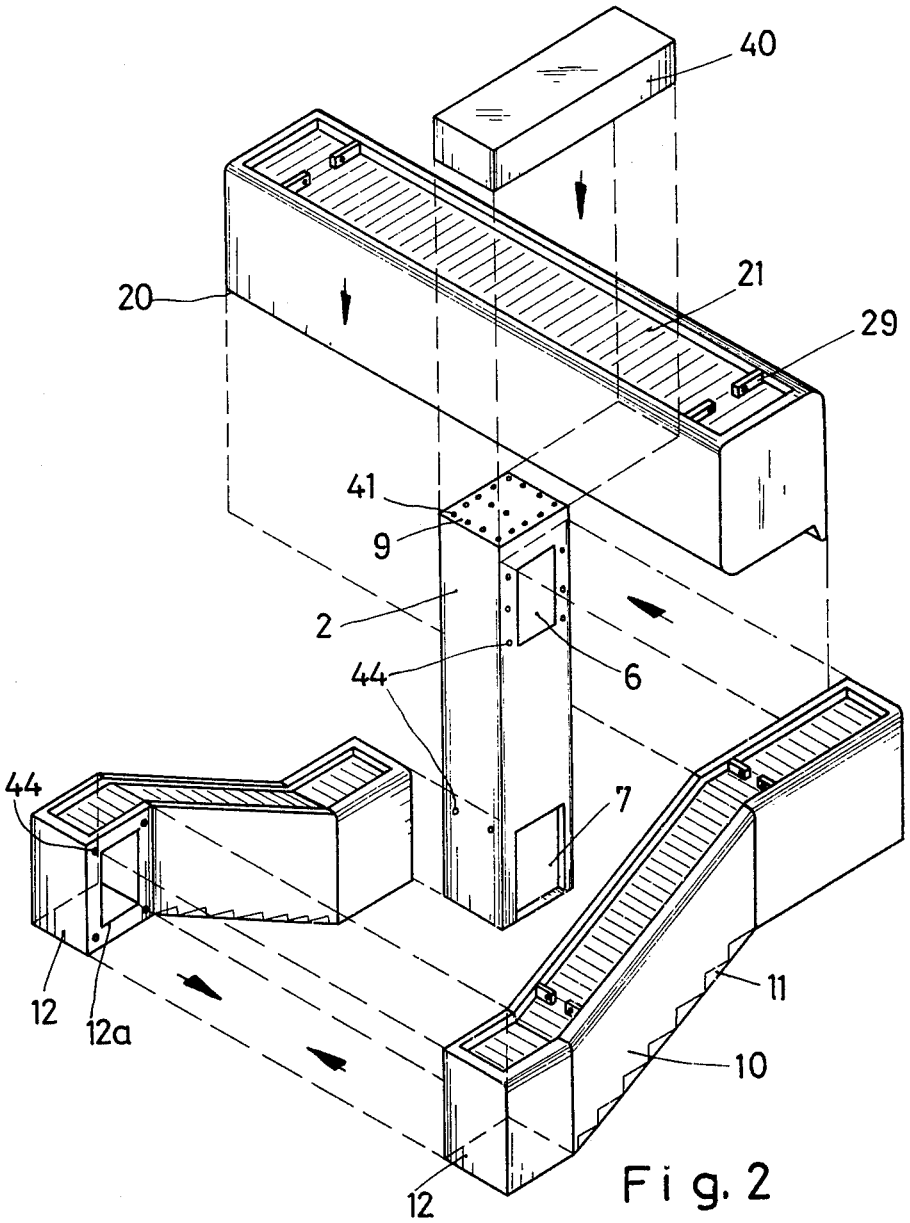
FIG. 2 is an exploded view of the related sections of the platform of FIG. 1, showing how the sections fit together.

FIG. 2 illustrates the assembly. After erecting girder 2, the sections of the two-well staircase 10 are attached to girder 2 and to each other at the level of intermediate landing 12 by means of screws 44, whereby opening 12*a* forms a flange. Girder 2 can then be walked on using stairs 11 of staircase 10 up to floor lever of platform 20. An assembly platform may be placed into elevator shaft 7 at the level of the upper elevator door 6 for tightening screws 41 to attach cantilever beam 40 on roof plate 9 of girder 2. Platform 20 hangs from suspension eyelets 29 located on roof 21 during assembly. Cantilever beam 40 may already be attached to roof 21.

Figure 3:
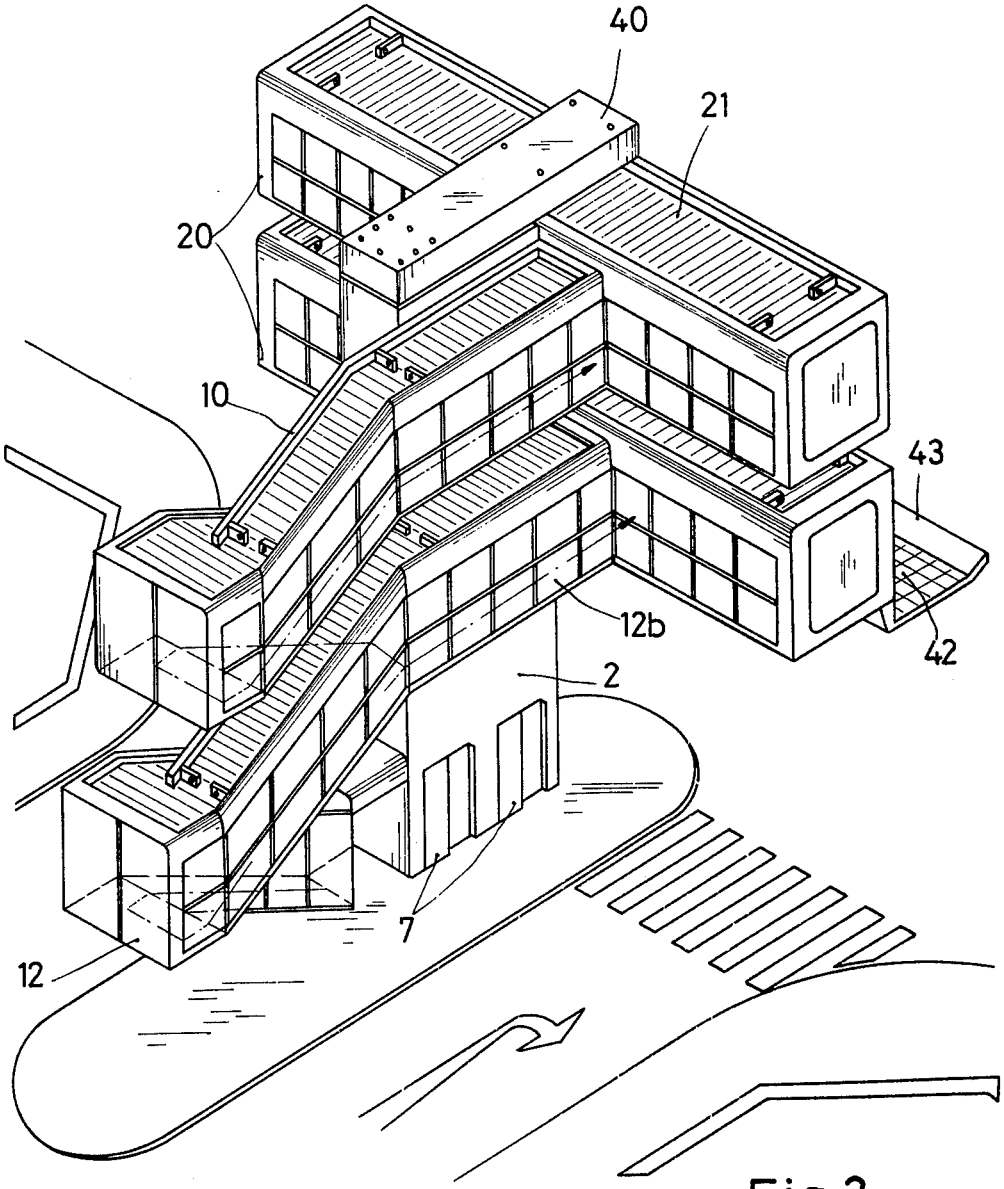
FIG. 3 is a view in perspective of a further embodiment of an elevated railway station embodying the invention, with two superimposed platforms.

The example according to FIG. 3 shows a twin column 2 on a traffic island. Twin column 2 has two separate shafts for the superimposed platforms 20. In this example a beam — not shown here — for upright and suspended vehicles passes platforms 20 in such a manner that the upright rail vehicles run on the beam at the level of the upper platform and the suspended vehicles hang from the beam at the level of the lower platform 20 of the elevated train station. The two-well staircase 10 leads from the traffic island via intermediate landing 12 to lower platform 20 and from an anteplatform 12*b* further to upper platform 20, as indicated by the dot-dash line. This drawing only contains the upper cantilever beam 40 for roof 21 of upper platform 20; the lower cantilever beam for the lower platform cannot be seen. Frame 43 with steel mesh 42 is located before the lower platform.

Figure 4:
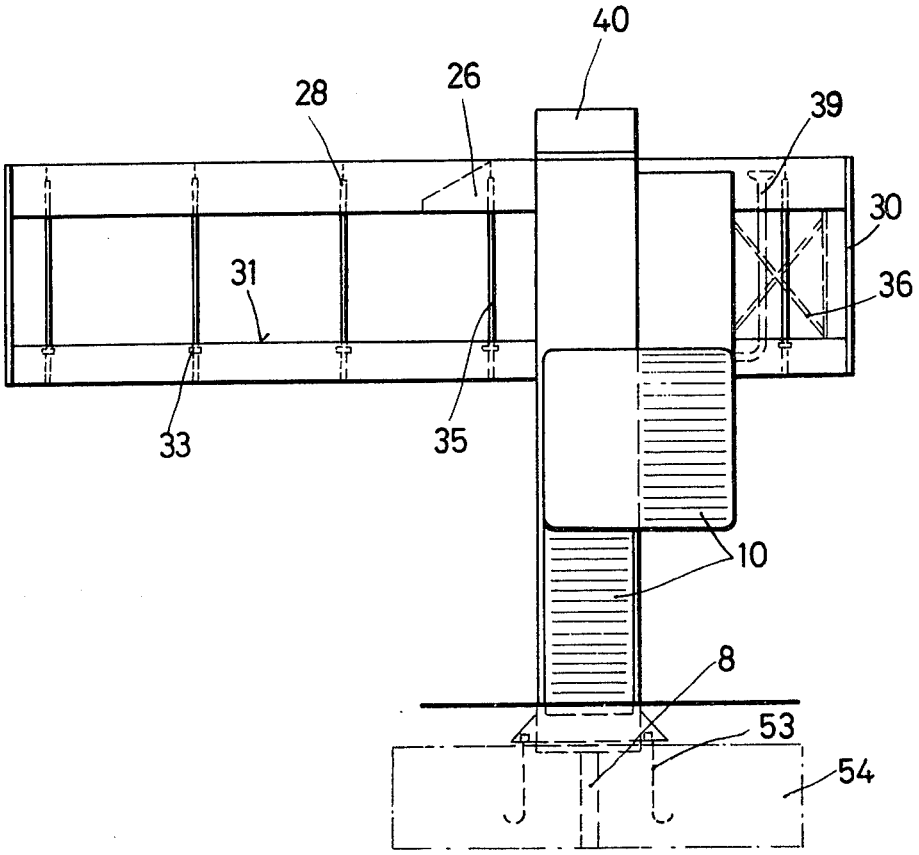
FIG. 4 is a rear elevational view of the station of FIG. 1.

FIG. 4 shows the rear view of the elevated train station with cross stays 28 in the roof and suspended bars 35 to carry floor cross beams 33 for floor 31. Furthermore, a reinforcement stay 26 with bevelled upper ends is discernible in the roof below cantilever beam 40, such stay 26 extending across several cross stays 28. The rear side wall of the elevated train station is provided with glass to the left of girder 2 between suspended bars 35, while the right side between staircase 10 and end wall 30 is provided with struts 36 and covered with sheet-metal plate. The sheet-metal plate also hides rain gutter 39 leading from the roof to girder 2. Girder 2 is attached to flat foundation 54 by means of anchor screws 53, and foundation 54 houses an elevator hoisting mechanism 8.

Figure 5:
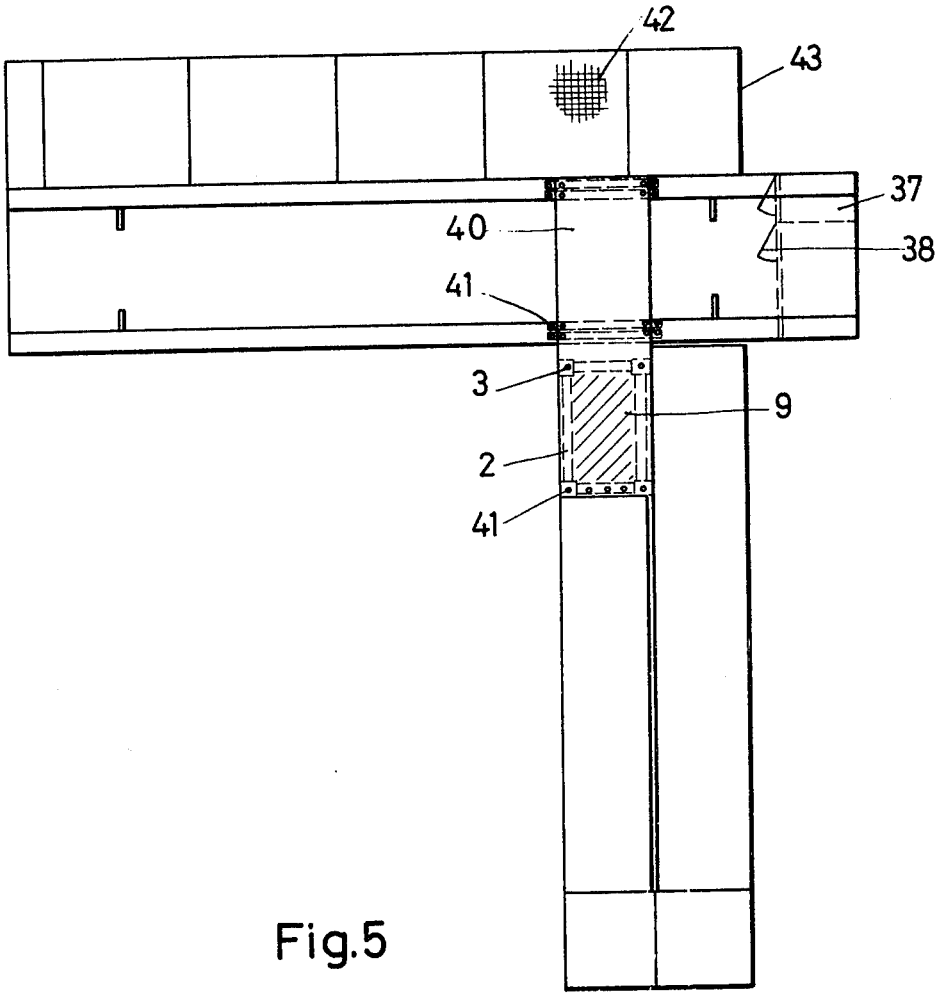
FIG. 5 is a top plan view of the station of FIG. 1.

FIG. 5 shows that the right quarter of the elevated train station houses maintenance and machine room 37 accessible through door 38. FIG. 5 shows furthermore four corner columns 3 of girder 2 and the arrangement of screws 41 penetrating cantilever beam 40, whereby it is to be noted that these are present only in the rear area of cantilever beam 40 above cover plate 9 to attach cantilever beam 40 in girder 2. Furthermore, frame 43 for thin steel mesh 42 can be seen before the platform.

Figure 6:
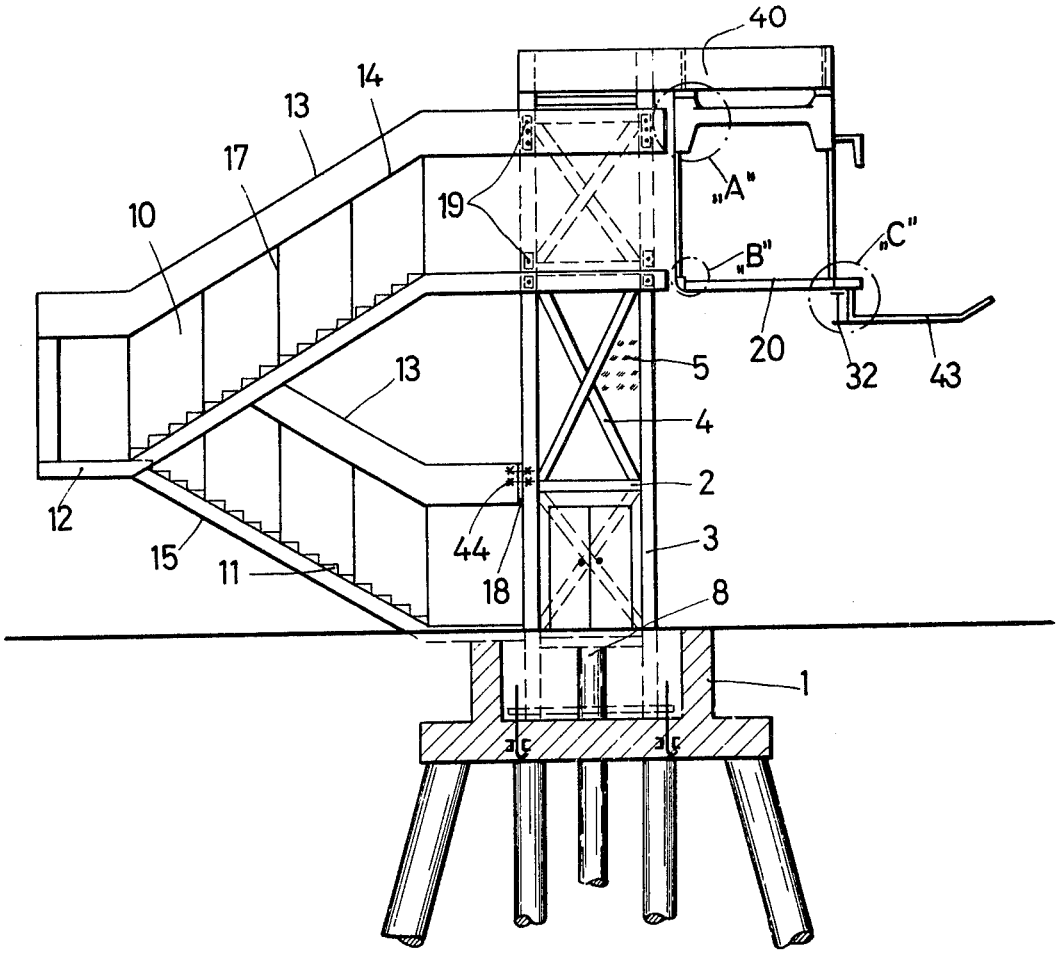
FIG. 6 is an end elevational view of the station of FIG. 1, with parts partially broken away for clarity.

In FIG. 6, roof-covered platform 20 is drawn in cross section, girder 2 and staircase 10 with stairs 11 in profile. The supporting parts of staircase 10 consist — as is also evident on FIG. 11 — essentially of upper belt 13 or support plate 13 with lowered belt edge 14, and lower belt or support plate 15 which is connected to the upper belt via bars 17. Upper and lower portions of staircase 10 are connected at the level of intermediate landing 12. Frontal plate 18 for screws 44 is welded to upper belt 13 of the lower staircase portion to attach the latter to girder 2. Accordingly, plates 19 are welded to belt edges 14 of the upper staircase portion and serve to attach the upper portion to that side of girder 2 resting on drill pole foundation 1. The drill pole foundation encompasses a space for elevator hoisting mechanism 8 below the ground.

The section through roof-covered platform 20 in FIG. 6 shows that the interior of the roof-covered platform is considerably higher than the entrance at the platform edge under which floor longitudinal beam 32 with frame 43 for the steel mesh is located. Furthermore, strutting 4 between corner columns 3 of girder 2 can be perceived with indicated lining or covering 5.

Figures 7, 8, 9, 10:
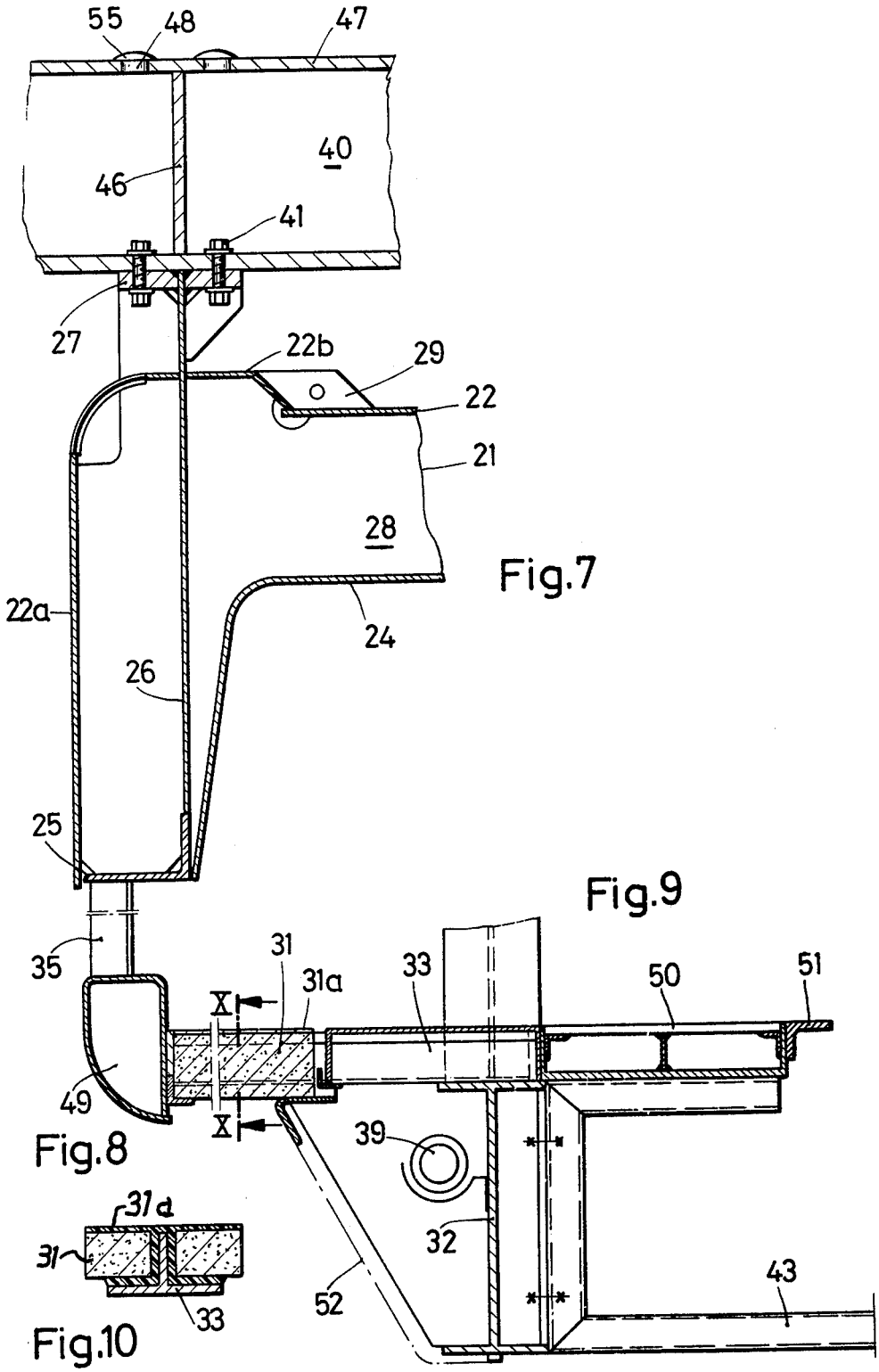
FIG. 7 is an enlarged view of that portion designated "A" in FIG. 6.
FIG. 8 is an enlarged view of that portion designated "B" in FIG. 6.
FIG. 9 is an enlarged view of that portion designated "C" in FIG. 6.
FIG. 10 is a sectional view along lines X—X of FIG. 8.

FIG. 7 shows in detail plate 22 of roof 21 with rim 22*b* and overhang 22*a*, whose lower edge is welded to a flat longitudinal profile plate 25. Next to overhang 22*a*, reinforcement stay 26 is located which penetrates rim 22*b* and whose top is provided with a screw flange 27 to attach it to box-shaped cantilever beam 40 provided with cross stays 46. Cantilever beam 40 has openings 48 in upper cover plate 47 to place screws 41. Openings 48 are closed after tightening screws 41 by gluing rubber caps 55 over them.

In the area of rim 22*b*, serving also as reinforcement, suspension eyelet 29 mentioned previously is welded to rim 22*b* and roof plate 22. Below plate 22 U-shaped cross stays 28 extending to longitudinal profile 25 are located, their bottom covered by cover plate 24.

Retaining bars 35 are welded under longitudinal plate 25 which assist in the application of the glass casing, and also support rear longitudinal beam 49 discernible in FIG. 8. This beams 49 is welded to floor cross beam 33 — shown on FIG. 10 — for floor 31 made of light concrete plates. Floor 31 is covered by easily cleaned floor covering 31*a*.

Figure 11:
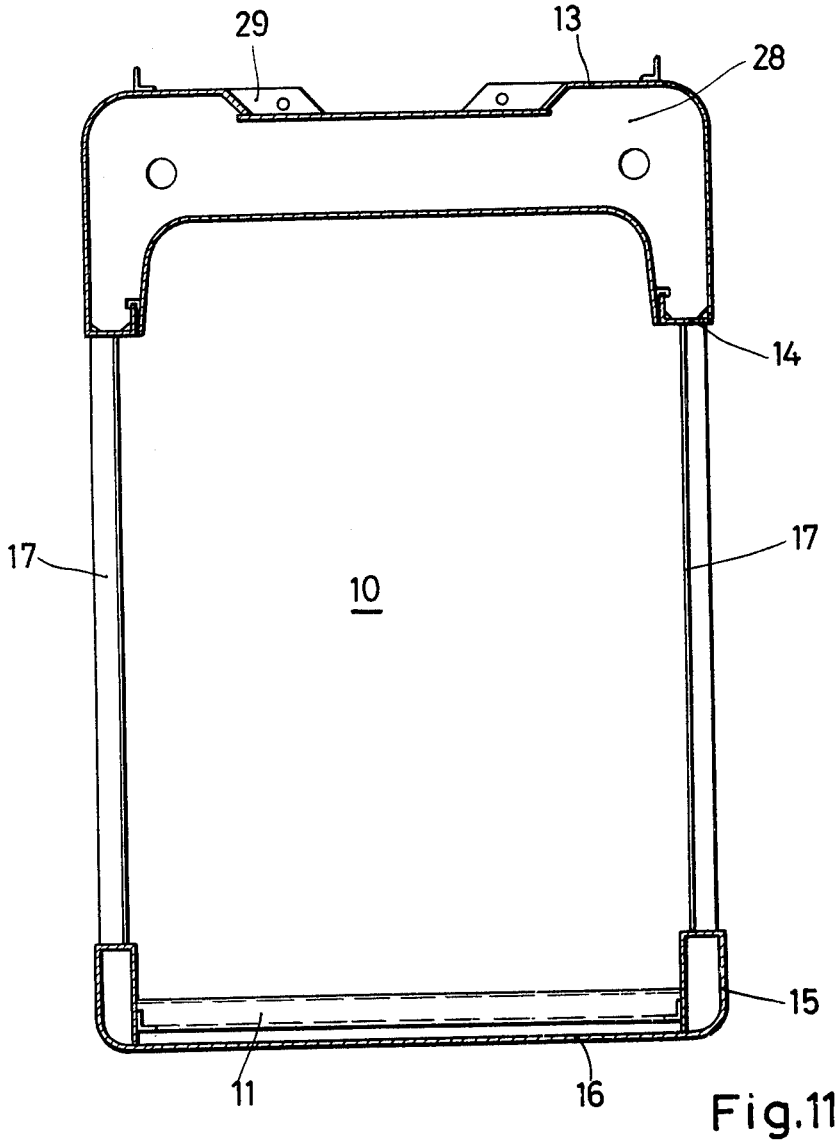
FIG. 11 is a cross section through a staircase illustrating the invention.

FIG. 9 shows a cross section through the platform edge with floor longitudinal beam 32 going from one end wall to the other and accommodating frame 43. Floor longitudinal beam 32 also supports obvious platform profile 50 consisting of narrow cross bars with conventional corner rim 51 which is also skid-resistant. The space next to floor longitudinal beam 32 is covered by plate 52 and forms a supply line shaft which houses, among other things, gutter 39 leading from both corners of the roof-covered platform to girder level with the usual incline. In this area gutter 39 emerges from the supply shaft and goes to girder 2. FIG. 11 shows a cross section through staircase 10, its roof forming upper belt or plate 13 with belt edge 14 and its floor has lower belt or plate 15 with tub-like plate 16. Upper belt 13 and lower belt 15 are interconnected via bars 17 with glass panes being attached to the latter. Tub-like plate 16 is located below stairs 11 welded between lower belts 15. Suspension eyelets 29 are attached to the roof of the staircase which is provided with a rim to catch water and cross stays 28.

We claim:

1. A station for elevated trains characterized by
(a) a single verticle support girder;
(b) a support beam cantilevered from said single support girder and supported solely upon said girder;
(c) an elevated station platform suspended from said support beam and positioned adjacent the right of way for the elevated trains, said platform supported solely on said support beam; and
(d) access means supported on said single girder and extending from the ground to said platform.

2. The station of claim 1, further characterized by
(a) said access means is a staircase.

3. The station of claim 1, further characterized by
(a) said single vertical support girder is an elevator shaft.

4. The station of claim 1, further characterized by
(a) a secondary vertical support girder supported on said cantilevered support beam;
(b) a secondary cantilevered support beam extending from said secondary vertical support girder;
(c) a second station platform suspended from said secondary cantilevered support beam;
(d) said second platform spaced vertically above said station platform; and
(e) secondary access means supported on said secondary vertical support girder and extending between said access means and said second platform.

5. The station of claim 1, further characterized by
(a) a platform roof suspended from one end of said cantilevered support beam;
(b) end walls suspended from each end of said roof;
(c) a plurality of spaced vertical supporting bars suspended along one side edge of said roof; and
(d) said platform suspended from said end walls and said spaced vertical bars.

6. The station of claim 5, further characterized by
(a) said access means is a staircase; and
(b) said staircase, said vertical support girder, said cantilevered support beam, and said platform including said roof, end walls and vertical bars are prefabricated for assembly at the station site.

7. The station of claim 5, further characterized by
(a) a top plate for said roof; and
(b) said top plate being substantially U-shaped in cross section with overhanging side edges.

8. The station of claim 7, further characterized by
(a) a plurality of spaced parallel U-shaped cross-stays in said roof extending between said overhanging side edges of said top plate and connected thereto;
(b) a longitudinally extending flat plate extending along said roof; and
(c) the bottom edge of said cross-stays connected to said flat plate.

9. The station of claim 8, further characterized by
(a) a vertical longitudinally extending reinforcement beam in said roof adjacent each end of said cross-stays;
(b) each said reinforcement beam extending through said roof plate and connected at the bottom edge thereof to said flat plate;
(c) a connecting flange on the top edge of each said reinforcement beam; and
(d) said flange connected to said cantilevered support beam.

10. The station of claim 8, further characterized by
(a) the top of each said parallel spaced supporting bars fixed to said roof flat plate;
(b) each said spaced vertical supporting bar having a horizontal floor crossbeam fixed thereon; and
(c) a longitudinally extending platform floor beam connected to the forward ends of said floor crossbeams.

11. The station of claim 10, further characterized by
(a) each end wall of said platform fixed to one end of said longitudinally extending platform floor beam.

12. The station of claim 10, further characterized by
(a) glass panes extending between said spaced vertical supporting bars to form one side wall of said platform.

13. The station of claim 7, further characterized by
(a) an integral raised portion around the side edges of said roof panel for preventing water from running off said roof panel; and
(b) a down spout connected to said roof panel for receiving water collected thereon.

14. The station of claim 10, further characterized by
(a) a plurality of lightweight concrete floor panels positioned on said floor crossbeams and said longitudinally extending platform floor beam.

15. The station of claim 2, further characterized by
(a) two flights extending in opposite directions to form said staircase;
(b) an intermediate landing interconnecting said flights; and
(c) the lower end of the lower flight and the upper end of the upper flight connected to said vertical support girder.

16. The station of claim 1, further characterized by said cantilevered support beam comprising
(a) a hollow box-like structure with an upper and lower wall; and
(b) a plurality of support spacers extending between said upper and lower walls.

17. The station of claim 1, further characterized by
(a) said platform and said vertical support girder are spaced from each other.

18. The station of claim 1, further characterized by said single vertical support girder comprising
(a) a vertical column at each corner of said girder;
(b) a plurality of struts extending between said columns;
(c) a covering over said columns and struts.

19. A station for elevated trains, characterized by
(a) a single vertical support girder;
(b) a station platform supported on said girder and positioned adjacent the right of way for the elevated trains;
(c) access means supported on said girder and extending from the ground to said platform;
(d) a support beam cantilevered from said support girder;

(e) a platform roof suspended from one end of said cantilevered support beam;
(f) end walls suspended from each end of said roof;
(g) a plurality of spaced vertical supporting bars suspended along one side edge of said roof;
(h) said platform suspended from said end walls and said spaced vertical bars;
(i) a top plate for said roof;
(j) said top plate being substantially U-shaped in cross section with overhanging side edges;
(k) an integral raised portion around the side edges of said roof panel for preventing water from running off said roof panel;
(l) a down spout connected to said roof panel for receiving water collected thereon; and
(m) a plurality of suspension eyelets in said roof panel, said eyelets integral with said integral raised portion.

20. A station for elevated trains, characterized by
(a) a single vertical support girder;
(b) a station platform supported on said girder and positioned adjacent the right of way for the elevated trains;
(c) access means supported on said girder and extending from the ground to said platform;
(d) a support beam cantilevered from said support girder;
(e) a platform roof suspended from one end of said cantilevered support beam;
(f) end walls suspended from each end of said roof;
(g) a plurality of spaced vertical supporting bars suspended along one side edge of said roof;
(h) said platform suspended from said end walls and said spaced vertical bars;
(i) a top plate for said roof;
(j) said top plate being substantially U-shaped in cross section with overhanging side edges;
(k) a plurality of spaced parallel U-shaped cross-stays in said roof extending between said overhanging side edges of said top plate and connected thereto;
(l) a longitudinally extending flat plate extending along said roof;
(m) the bottom edge of said cross-stays connected to said flat plate;
(n) the top of each said parallel spaced supporting bars fixed to said roof flat plate;
(o) each said spaced vertical supporting bar having a horizontal floor crossbeam fixed thereon;
(p) a longitudinally extending platform floor beam connected to the forward ends of said floor crossbeams; and
(q) a horizontal protection screen fixed along the open side edge of said station platform.

21. A station for elevated trains, characterized by
(a) a single vertical support girder;
(b) a station platform supported on said girder and positioned adjacent the right of way for the elevated trains;
(c) a staircase supported on said girder and extending from the ground to said platform;
(d) said staircase including two flights extending in opposite directions;
(e) an intermediate landing interconnecting said flights;
(f) the lower end of the lower flight and the upper end of the upper flight connected to said vertical support girder;
(g) a portion of each flight comprising a portion of said intermediate landing;
(h) each flight comprising a longitudinally extending inclined, enclosed rectangular supporting profile; and
(i) the side walls of the supporting profile of each flight having an opening adjacent said landing.

22. The station of claim 21, further characterized by said profile of each flight comprising
(a) opposed upper and lower U-shaped support structures; and
(b) a plurality of spaced vertical rods extending between said upper and lower support structures.

23. The station of claim 22, further characterized by
(a) glass panels extending between said spaced vertical rods.

24. The station of claim 22, further characterized by
(a) a plurality of integral suspension eyelets on said upper support structure.

25. A station for elevated trains, characterized by
(a) a single vertical support girder;
(b) a station platform supported on said girder and positioned adjacent the right of way for the elevated trains;
(c) a staircase supported on said girder and extending from the ground to said platform;
(d) said single vertical support girder is an elevator shaft;
(e) an elevator hoisting mechanism positioned below said elevator shaft underground; and
(f) said hoisting mechanism is a telescoping hydraulic cylinder.

* * * * *